US005348054A

United States Patent [19]

Oertli

[11] Patent Number: 5,348,054

[45] Date of Patent: Sep. 20, 1994

[54] DEVICE FOR MAKING A HINGED CONNECTION BETWEEN TWO PARTS IN A LOOM

[75] Inventor: Gustav Oertli, Brütten, Switzerland

[73] Assignee: Sulzer Ruti AG, Ruti, Switzerland

[21] Appl. No.: 125,041

[22] Filed: Sep. 21, 1993

[30] Foreign Application Priority Data

Nov. 13, 1992 [EP] European Pat. Off. ..... 92810887.7

[51] Int. Cl.[5] ..... D03C 1/14

[52] U.S. Cl. ..... 139/57; 16/340; 403/405.1; 403/362

[58] Field of Search ..... 139/57, 88, 91; 16/264, 16/340, 381; 403/119, 405.1, 362; 384/396; 411/338

[56] References Cited

U.S. PATENT DOCUMENTS

| | | | |
|---|---|---|---|
| 1,365,532 | 1/1921 | Mountain | 16/340 |
| 2,743,657 | 5/1956 | Kriegbaum | 403/405.1 X |
| 3,871,417 | 3/1975 | Filter | 139/88 |
| 3,967,653 | 7/1976 | Lyman . | |
| 4,422,481 | 12/1983 | Palau | 139/88 |
| 4,687,030 | 8/1987 | Faasse . | |

FOREIGN PATENT DOCUMENTS

| | | |
|---|---|---|
| 0241968 | 10/1987 | European Pat. Off. . |
| 2345754 | 3/1975 | Fed. Rep. of Germany . |
| 2466542 | 4/1981 | France . |
| 2621362 | 4/1989 | France . |

*Primary Examiner*—Andrew M. Falik
*Attorney, Agent, or Firm*—Townsend and Townsend Khourie and Crew

[57] ABSTRACT

A device for coupling two outer parts (3) to a third part (2) disposed therebetween. The device includes a plurality of fasteners 7 each threadably mounted to an opening (9) in one of the outer parts and a cylindrical recess (6*a*) in the third part. Each fastener 7 has a conical head 7*a* that rests against the opening in the outer part. The outer parts project over the cylindrical recess so that an annular cavity is formed between the head of the fastener and the third part. Thus, the head of the fastener elastically deforms the outer part into the annular cavity so that additional forces may be transmitted from the outer part to the third part. In addition, the inner surface of each outer part is parallel to the third part so that the third part may be replaced without any effective movement of the outer parts.

18 Claims, 2 Drawing Sheets

Fig.1
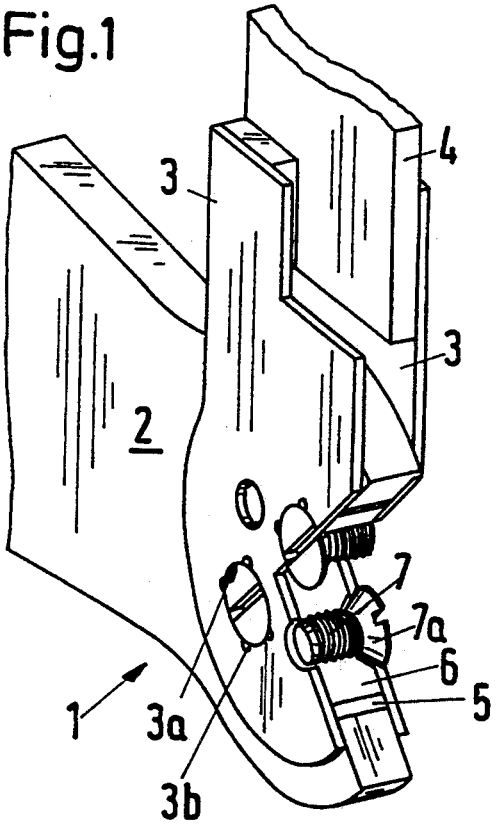
Fig.4
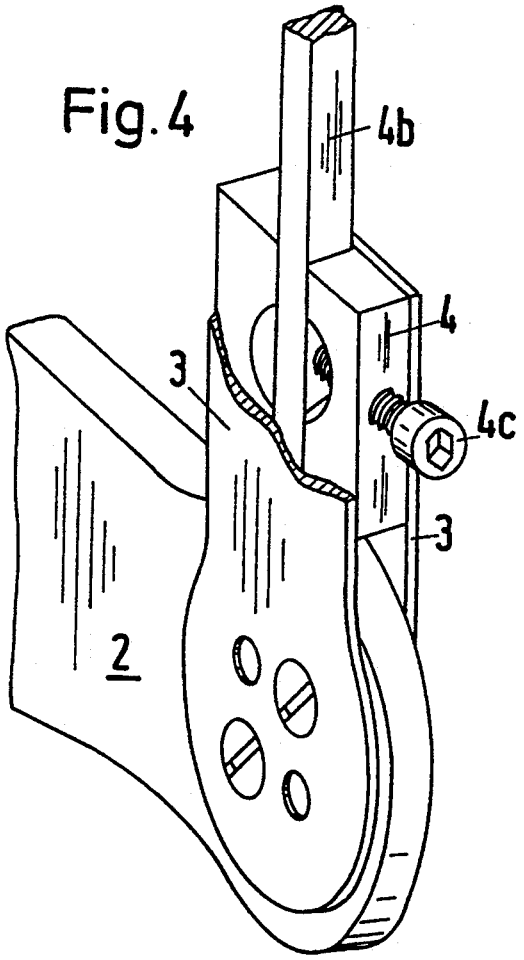
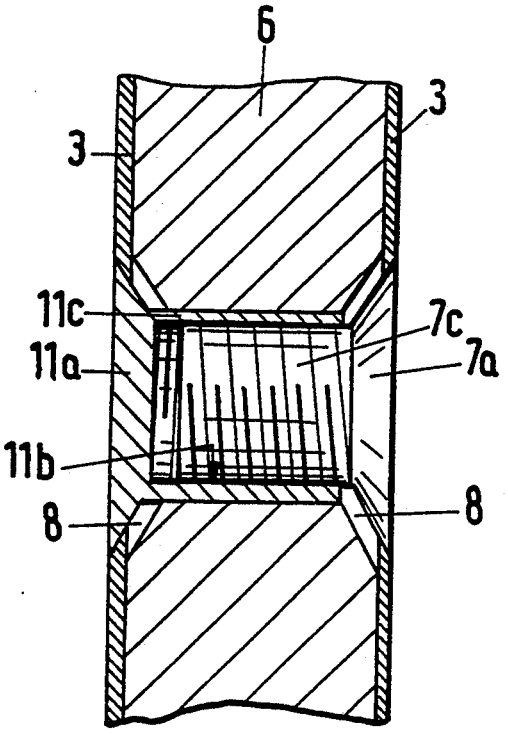
Fig.3

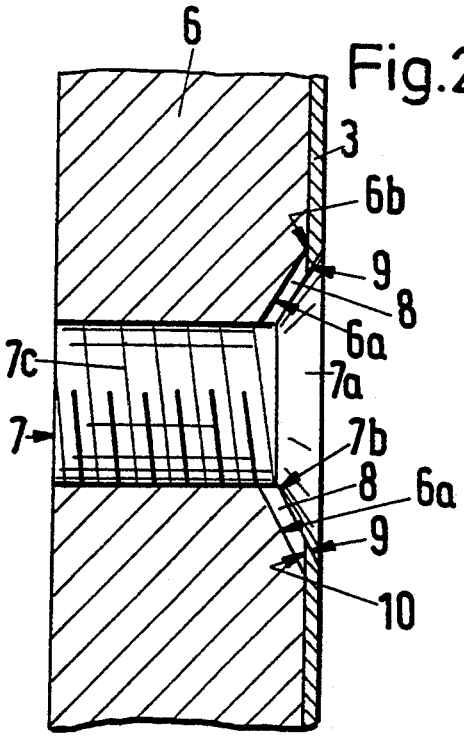
Fig.2a
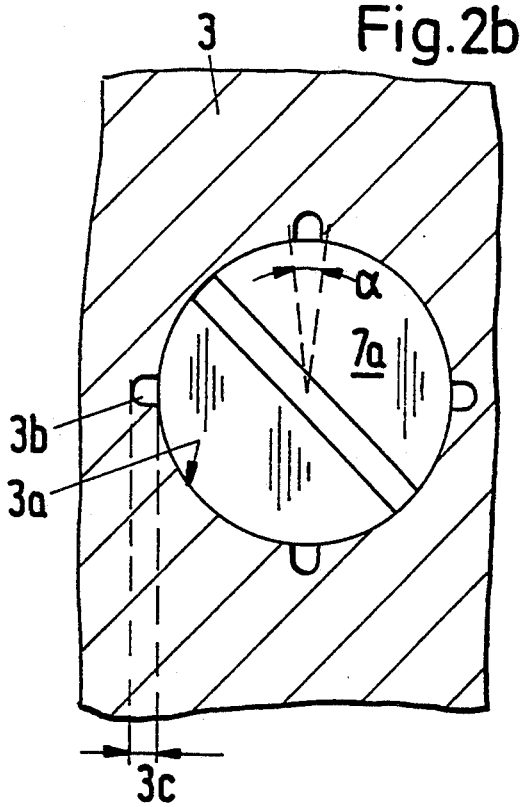
Fig.2b
Fig.2c
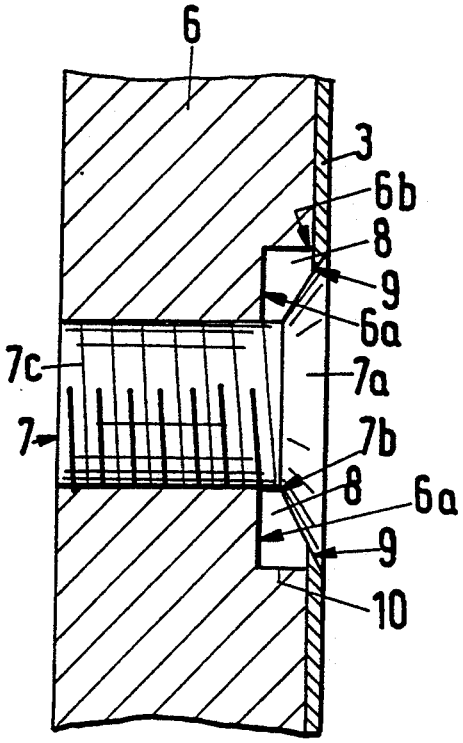
Fig.2d
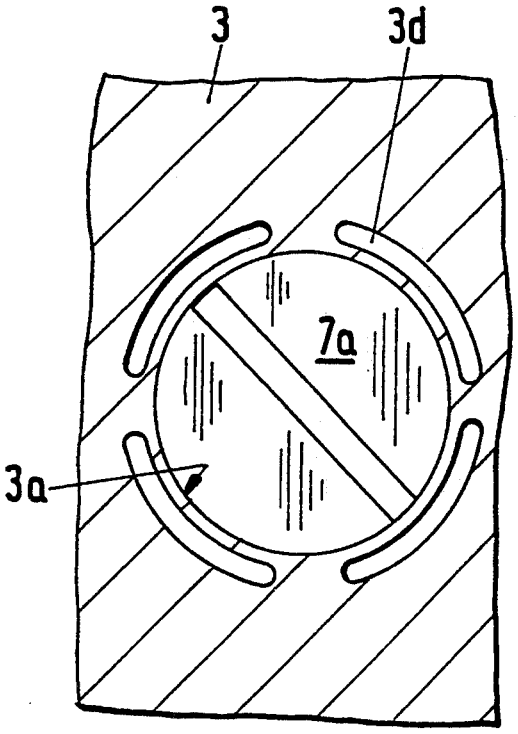

DEVICE FOR MAKING A HINGED CONNECTION BETWEEN TWO PARTS IN A LOOM

BACKGROUND OF THE INVENTION

The invention refers to a device for making a hinged connection between parts. It further refers to heald rods, heald drives and looms with a device in accordance with the invention.

From the DE-OS 23 45 754, a device is known having a socket for mounting a pivot between two parallel parts. A pivot which may be interposed between the two parallel parts is supported by the socket in a hinge.

But such an execution exhibits certain disadvantages. The loosening or exchange of a pivot or respectively the dismantling of a socket is relatively complicated since the distance between the two parallel parts at the point of dismantling has to be increased. Loosening of the parts without bending means that the two parallel parts have to be loosened over their whole length. In loosening the parts by bending, there exists the risk of plastic deformation.

Additional disadvantages arise if at a point of dismantling further mechanical components restrict, for example, the accessibility or freedom of movement of the two parallel parts. Thus the heald drive of a loom, for example, exhibits a plurality of hinges and rods which, corresponding with the pitch of the heald frames, usually lie very closely side by side. Loosening or exchange of hinges or rods is therefore, correspondingly elaborate.

SUMMARY OF THE INVENTION

The problem of the invention is, therefore, to connect two parallel parts in a hinge to a third part without having to spread the two parts running in parallel when building in the third part or taking it out.

The advantages of the invention are to be seen in that the third part held in a hinge may be loosened and dismantled rapidly and without deformation of the two parallel parts. Bending the two parallel parts during loosening has hitherto caused a relatively long length of leg of the two parallel parts between the socket and a fixed point of clamping in order either to exclude plastic bending or in the case of plastic bending to keep the forces at opening within a low manageable range. Since with the device in accordance with the invention no deformation is necessary, the legs of the two parallel parts lying between the hinge bearing and the fixed point of clamp may be made very short.

BRIEF DESCRIPTION OF THE DRAWINGS

The invention is described below with the aid of embodiments There is shown in:

FIG. 1 a perspective of the device in accordance with the invention;

FIG. 2*a* a section with a singlesided means of fastening;

FIG. 2*b* a plan of one part with means of fastening;

FIG. 2*c* a further section with a singlesided means of fastening;

FIG. 2*d* a further plan of one part with means of fastening;

FIG. 3 a section with a doublesided connector element;

FIG. 4 a perspective of a device in accordance with the invention with a heald rod clamped in.

DESCRIPTION OF THE PREFERRED EMBODIMENT

FIG. 1 shows a device 1 for the connection of two parallel parts 3 in a hinge to a third part 2. On the one side the two parallel parts 3 are connected firmly to a means 4 of transmitting force. The opposite end of the legs of the two parallel parts 3 lies on a bearing part 6 and are connected by at least one means of fastening 7, for example, a screw, to the bearing part 6. The further part 2, e.g., a crank on a heald drive, embraces the bearing part 6 and hence is connected in a hinge to the two parallel parts 3, where for reducing the friction a slide bearing with a bearing ring 5 or a roller bearing, for example, may be used. For loosening the connection between the parts 2 and 3 all of the means 7 of fastening are removed from the bearing part 6, whereupon the part 2 may be slid out between the two parallel parts 3.

FIG. 2*a* shows a cross-section through a means 7 of fastening which connects a part 3 to a bearing part 6. The bearing part 6 exhibits an axial bore in which as the means of fastening 7 there is a screw with a screw body 7*c* and a conical screwhead 7*a*. Corresponding with the frustoconical bearing area 7*b* of the screw head 7*a*, a bore is let into the part 3 and exhibits, for example, a frustoconical bearing area 9, so that the screw head 7*a* rests against it in partial regions of the frustoconical bearer 7*b*. In the bearing part 6 the region of the bore lying directly below the screw head 7*a* is countersunk, for example, frustoconically in such a way that between the flanks of the recess 6*a* and the frustoconical bearer 7*b* a cavity 8 always exists, so that the screw head 7*a* rests directly and exerts forces only upon the part 3. At the same time the diameter of the recesses 6*a* at the surface of the bearing part 6 is chosen to be greater than the diameter of the bore lying above it in the part 3, so that between the part 3 and the bearing part 6 a circular exposed area 10 arises. Upon screwing together and tightening up the parts 3 and 6 the frustoconical bearer 7*b* becomes pressed against the part 3 in the region of the bearing area 9, the part 3 in the region of the exposed area 10 being elastically deformable. This assists the transmission of the forces between the parts 3 and the bearing part 6 and in addition allows the fastener 7 to be clamped springily, which impedes loosening of the fastener 7.

For connecting the bearing part 6 to the two parallel parts 3 one single means of fastening 7 is sufficient. But for a more uniform transmission of the forces a number of means of fastening 7 are advantageous, for example, in an arrangement of four means of fastening 7 as represented in FIG. 1, which are arranged symmetrically about the axis of rotation of the hinge connection. In its final position the screw head 7*a* advantageously comes to lie in the part 3 in such a way that the screw head 7*a* does not project above the surface of the part 3.

FIG. 2*b* shows a plan of the part 3 with the springily clamped screw head 7*a*, the bearing area 9 of which rests partially against the part 3. The inner edge 3*a* of the recess in the part 3 may be made continuously circular or as represented in FIG. 2*b* be interrupted by radial grooves 3*b* . The exposed area 10 on the part 3 has the effect that the part 3 exerts a springy action upon the screw head 7*a*, in which case the spring force or respectively the corresponding spring travel may be determined by the form and number of the radial grooves 3*b*. The groove 3*b* may be made in various ways, where the radial width 3*c* as well as the angular width $\alpha$ of the groove 3b exercise the most considerable contribution to the spring characteristic. The elastic bending of the part 3 between the edge 6b of the recess 6a in the bearing part 6 and the bearing area 9 has the effect that between the part 3 and the bearing part 6 additional forces may be transmitted via the edge 6b.

FIG. 2c shows a further cross-section through a means of fastening 7 which connects a part 3 to the bearing part 6. The recess 6a in the region of the axis of the means of fastening 7 or running coaxially with the axis is in that case made cylindrical. The circular recess 6a exhibits at the surface of the bearing part 6 a diameter which is greater than the diameter of the bore in the part 3 lying above it.

FIG. 2d shows a further embodiment for influencing the springy action of the part 3 against the clamped-in screwhead 7a. Along the circumference 3a of the bore in the part 3 against which rests a head 7a, 11a, apertures are incorporated which are spaced by a fraction of a diameter of the bore from the circumference 3a. The apertures 3d may be arranged in very different ways. In the embodiment four apertures 3d are represented, like segments of circles running concentrically about the bore. The arrangement and size of the apertures 3d influence the spring action of the part 3 against the head 7a, 11a, and the elastic deformation respectively of those regions in particular of the part 3 which lie above the cavity 8 in the recess 6a. Through the elastic deformation of the part 3 correspondingly higher forces may be transmitted between the parts 3 and 6 via the edge 6b.

FIG. 3 shows a further means of fastening which presses both parallel parts 3 against the bearing part 6. The means of fastening is composed on one side of a screw with a screw body 7c and screwhead 7a, and on the other side of a screw with a hollow screw body 11c which exhibits an axial tapped hole, and a screwhead 11a. The screwhead 11a exhibits the same properties as the screwhead 7a described in detail by FIG. 2a. For uniform transmission of the forces between the two parallel parts 3 and the bearing part 6 one single means of fastening is sufficient, in the execution represented in FIG. 3.

In FIGS. 1 to 3 it has always been screws which have been described as the means of fastening 7 and 11. This is to be understood only as by way of example; certainly there are other means of fastening having the same action.

FIG. 4 shows an embodiment of the means 4 of transmission of force, which exhibits a recess for guiding a rod 4b which is, for example, round, prismatic or rectangular. A means of fastening 4c on the one hand allows the rod 4b to be loosened so that the free length of the rod 4b may be adjusted, and on the other hand allows the rod 4b to be fixed in the means 4 of transmission of force. The rod 4b, may, for example, be made rigid or elastic in bending.

I claim:

1. A device for coupling first and second parallel parts to a third part therebetween, the device comprising:

at least one fastener removably mounted to the third part and the parallel parts, the fastener having a head with a frustoconical profile;

the third part having a recess with an outer conical portion, the conical portion having an outer diameter; and at least one of the parallel parts having an opening with an inner diameter and a circumference, the inner diameter being smaller than the outer diameter of the conical portion so that the head of the fastener rests against said parallel part, the opening including grooves positioned along the circumference of the conical portion of the recess.

2. A device for coupling first and second parallel parts to a third part therebetween, the device comprising:

at least one fastener removably mounted to the third part and the parallel parts, the fastener having a head with a frustoconical profile;

the third part having a recess with an outer conical portion, the conical portion having an outer diameter; and at least one of the parallel parts having a circular opening with an inner diameter and a circumference, the inner diameter being smaller than the outer diameter of the conical portion so that the head of the fastener rests against said parallel part, said parallel part including openings spaced away from the circumference by a distance substantially less than the inner diameter.

3. A device as in claim 2 wherein the openings extend concentrically around the head of the fastener.

4. A device for coupling first and second parallel parts to a third part therebetween, the device comprising:

at least one fastener removably mounted to the bearing part and the parallel parts, the fastener having a head with a frustoconical profile;

the third part having a recess with an outer conical portion, the conical portion having an outer diameter;

at least one of the parallel parts having an opening with an inner diameter and a circumference, the inner diameter being smaller than the outer diameter of the conical portion so that the head of the fastener rests against said parallel part;

means for transmitting force coupled to the parallel parts; and a cylindrical rod fitted within the force transmitting means.

5. A device as in claim 4 wherein the rod is connected rigidly to the force transmitting means.

6. A device as in claim 4 wherein the rod is longitudinally adjustable, the device further including means for securing the rod within the force transmitting means.

7. A device as in claim 6 wherein the securing means is fitted perpendicular to the direction of the rod, the securing means exerting an adjustable force upon the rod.

8. A heald rod of a loom having a device for making a hinged connection between first and second parallel parts and a third part, the device comprising:

a bearing part rotatably coupled to the third part and disposed between the parallel parts;

a plurality of fasteners removably mounted to the bearing part and the parallel parts, the fasteners each having a head with a frustoconical profile;

the bearing part having a cavity for each fastener, each cavity having an outer conical portion with a circumferential edge; and the parallel parts each having circular openings aligned with the conical portion of the cavities in the bearing part, the circular openings each being sized so that the parallel parts project over the circumferential edge of each conical portion, the parallel parts each having an inner surface in contact with the bearing part, the inner surfaces being parallel to the bearing part over their entire extent so that the bearing part may be removed without effectively changing the distance between said inner surfaces.

9. A heald drive of a loom having a plurality of rods, each rod having a device for making a hinged connection between first and second parallel parts and a third part, the device comprising:

a bearing part rotatably coupled to the third part and disposed between the parallel parts;

a plurality of fasteners removably mounted to the bearing part and the parallel parts, the fasteners each having a head with a frustoconical profile;

the bearing part having a cavity for each fastener, each cavity having an outer conical portion with a circumferential edge; and the parallel parts each having circular openings aligned with the conical portion of the cavities in the bearing part, the circular openings each being sized so that the parallel parts project over the circumferential edge of each conical portion, the parallel parts each having an inner surface in contact with the bearing part, the inner surfaces being parallel to the bearing part over their entire effective extent so that the bearing part may be removed without effectively changing the distance between said inner surfaces.

10. A loom with a plurality of rods, each rod having a rod for making a hinged connection between first and second parallel parts and a third part, the device comprising:

a bearing part rotatably coupled to the third part and disposed between the parallel parts;

a plurality of fasteners removably mounted to the bearing part and the parallel parts, the fasteners each having a head with a frustoconical profile;

the bearing part having a cavity for each fastener, each cavity having an outer conical portion with a circumferential edge; and the parallel parts each having circular openings aligned with the conical portion of the cavities in the bearing part, the circular openings each sized so that the parallel parts project over the circumferential edge of each conical portion, the parallel parts each having an inner surface in contact with the bearing part, the inner surfaces being parallel to the bearing part so that the bearing part may be removed without effectively changing the distance between said inner surfaces.

11. A device for coupling first and second outer parts to a third part therebetween, the device comprising:

a plurality of fasteners removably mounted to the third part and the outer parts, each fastener having a head with a frustoconical profile; and the third part having a cavity for each fastener, each cavity having an outer conical portion with a circumferential edge;

the outer parts each having circular openings aligned with the conical portion of the cavities in the third part, the circular openings each sized so that the outer parts project over the circumferential edge of each conical portion, the outer parts each having an inner surface in contact with the third part which is parallel to the third part so that the third part may be removed without effectively changing the distance between said inner surfaces.

12. A device as in claim 11 wherein the opening in said parallel part is countersunk frustoconically.

13. A device as in claim 11 wherein said parallel part has an outer surface and the head has a top surface, the outer surface and the top surface being aligned in the same plane when the fastener is completely mounted within the bearing part.

14. A device as in claim 11 wherein the fastener is threadably coupled to the third part.

15. A device as in claim 11 wherein the fastener comprises first and second elements, the first element having a tapped hole and the second element having a body sized to engage the tapped hole.

16. A device for coupling first and second outer parts to a third part therebetween, the device comprising:

a plurality of fasteners removably mounted to the third part and the outer parts, each fastener having a head with a frustoconical profile; and the third part having a cavity for each fastener, each cavity having an outer conical portion with an outer diameter;

the outer parts each having a circular opening with an interior surface, the interior surface having an inner diameter that is smaller than the outer diameter of the conical portion so that the head of the fastener rests against the interior surface of the circular opening and an annular cavity is formed between the head and the third part, the outer parts being elastically deformed into the cavity by a force from the fasteners to impede loosening of the fasteners.

17. The device of claim 16 wherein the annular cavity has a generally conical cross-sectional shape.

18. The device of claim 16 wherein the fastener has a cylindrical body within the recess, the annular cavity having a generally cylindrical cross-sectional shape that extends within the third part adjacent a portion of the cylindrical body of the fastener.

* * * * *